United States Patent [19]

Rost et al.

[11] Patent Number: 4,742,972

[45] Date of Patent: May 10, 1988

[54] CARRIER FOR TEXTILE YARN

[75] Inventors: Karl H. Rost; Samuel F. Adams, both of Greenville, S.C.

[73] Assignee: Sonoco Products Company, Hartsville, S.C.

[21] Appl. No.: 49,118

[22] Filed: May 13, 1987

[51] Int. Cl.[4] ..... B65H 75/10

[52] U.S. Cl. ..... 242/118.31; 242/118.32

[58] Field of Search ..... 242/118.3, 118.31, 118.32

[56] References Cited

U.S. PATENT DOCUMENTS

| | | | |
|---|---|---|---|
| 71,371 | 11/1867 | Fiske | 242/118.3 |
| 202,664 | 4/1878 | Porter | 242/118.3 |
| 335,783 | 2/1886 | Stone | 242/118.3 |
| 691,816 | 1/1902 | Smith | 242/118.3 X |
| 737,531 | 8/1903 | Thorne | 242/118.32 |
| 1,156,193 | 10/1915 | Ward | 242/118.32 |
| 1,264,351 | 4/1918 | Ward | 242/118.32 |
| 3,138,345 | 6/1964 | Luber | 242/118.3 X |
| 3,141,631 | 7/1964 | Krebs | 242/118.3 |
| 3,532,291 | 10/1970 | Newman | 242/118.31 |
| 3,889,899 | 6/1975 | Adams et al. | 242/118.32 |
| 4,519,557 | 5/1985 | Newman | 242/118.31 |

OTHER PUBLICATIONS

Photocopies of an Elongated Plastic Yarn Carrier Having Stepped Sections Manufactured by Textube Corporation.

*Primary Examiner*—David Werner

*Attorney, Agent, or Firm*—Bell, Seltzer, Park & Gibson

[57] ABSTRACT

A carrier for textile yarn characterized by a construction designed to prevent undesirable sloughing-off or migration of the yarn during winding and unwinding and to reduce the amount of material needed to construct the carrier while retaining desired crush strength includes generally the following. An elongate hollow body having a transverse circular cross-section defines an outside surface of consecutive stepped portions extending around the body along the length of the carrier for defining a saw-toothed longitudinal configuration and yarn carrier areas which prevent undesirable sloughing-off or migration of the textile yarn during winding and unwinding. The inside surface of the body also includes somewhat similar consecutive stepped portions for cooperating with the outside surface to reduce the amount of material needed to construct the carrier while retaining a surface to fit the spindle of a textile machine. Opposing stepped portions of the outside and inside surfaces are positioned in a generally longitudinally staggered relationship for defining transverse portions in the body of the same radial thickness as would be present if the outside and inside surfaces were of a smooth unstepped configuration to provide reinforcement and crush strength to the carrier.

12 Claims, 2 Drawing Sheets

CARRIER FOR TEXTILE YARN

FIELD OF THE INVENTION

This invention relates to a carrier for textile yarn characterized by a construction designed to prevent undesirable sloughing-off or migration of the textile yarn during winding and unwinding and to reduce the amount of material needed to construct the carrier while retaining desired crush strength.

BACKGROUND OF THE INVENTION

Carriers are utilized in many textile manufacturing operations for the winding of textile yarn thereon and the unwinding of textile yarn therefrom. These yarn carriers come in many configurations utilizing an elongate hollow body having a transverse circular cross-section and defining an outside surface for receiving wound textile yarn thereon and an inside surface for mounting the carrier on a spindle of a textile machine for winding and unwinding of the yarn. These configurations include cones, cylinders, spools, tubes, pirns, etc. Although some of these yarn carriers are generally cylindrical, many are tapered and have widely varying internal and external tapers depending upon the winding and unwinding properties and precision fit requirements for the spindle of the textile machine and depending upon the particular type of yarn and textile manufacturing operation. These yarn carriers have been constructed of impregnated paper, wood, metal and other materials; however, in recent times many of the textile yarn carriers have been molded from plastic materials.

With all these types of carriers for textile yarn, problems to some degree are presented with undesirable sloughing-off or migration of the textile yarn during winding and unwinding and with minimizing the amount of material needed to construct the carrier while retaining desired crush strength of the carrier necessary to withstand the winding forces produced by the yarn on the carrier.

In order to minimize undesirable sloughing-off or migration of the yarn during winding and unwinding of the yarn on these carriers, various abrasive surfaces have been formed on the outside surface of the carrier by knurling or otherwise forming a rough surface. While some of these abrasive surfaces have minimized undesirable sloughing-off or migration of the yarn during winding and unwinding operations, these abrasive surfaces have presented other problems in that some types of yarn snag or are otherwise damaged during the winding or unwinding operations. These problems are particularly acute with cross wound textile yarn packages since the yarn is traversed during the winding operation from one end of the carrier to the other.

While stepped outside configurations producing a generally saw-toothed longitudinal cross-section have been suggested for the outside surface of such textile yarn carriers, the configurations thereof have not been totally successful in minimizing undesirable sloughing or migration of the yarn, particularly for cross-wound textile yarn packages.

Problems have also existed with construction of these types of yarn carriers is to minimize the material utilized for such yarn carriers, particularly molded plastic yarn carriers, while retaining desired crush strength for the carriers against the forces produced by the wound textile yarn. Attempts to minimize the material utilized in such textile yarn carriers have included cutting away or reducing the material in molded plastic carriers from the inside surface of the carrier while retaining longitudinally extending reinforcing ribs or the like to allow the carrier to fit a spindle of a textile yarn processing machine. However, these problems would become more acute when utilizing an outside stepped or saw-toothed configuration inasmuch as material is already removed or eliminated from the inwardly stepped portions of the thickness of the carrier which weaken the crush strength of the carrier.

OBJECT AND SUMMARY OF THE PRESENT INVENTION

Accordingly, it is the object of the present invention to overcome the above problems and provide a construction for a textile yarn carrier which prevents undesirable sloughing-off or migration of the textile yarn during winding and unwinding and which minimizes the amount of material needed to construct the carrier while retaining desired crush strength.

It has been found by this invention that the above object may be accomplished by providing a carrier for textile yarn including generally the following construction.

The carrier is constructed from an elongate hollow body having a transverse circular cross-section which defines an outside surface for receiving wound textile yarn thereon and an inside surface for mounting the carrier on a spindle of textile machine for winding and unwinding of the yarn. The outside surface comprises consecutive stepped portions extending around the body along substantially the length of the carrier for defining a generally saw-toothed longitudinal cross-section and yarn carrying areas which prevent undesirable sloughing-off or migration of the textile yarn during winding and unwinding. The inside surface comprises consecutive stepped portions extending around the body along substantially the length of the carrier for defining a generally saw-toothed longitudinal cross-section and for cooperating with the outside surface to reduce the amount of material needed to construct the carrier. Opposing stepped portions of the outside surface and the inside surface are positioned in a generally longitudinally staggered relationship for defining transverse portions in the body of the same radial thickness as would be present if the outside and inside surfaces were of a smooth unstepped configuration to provide reinforcement and crush strength to the carrier.

Preferably, each of the stepped portions of the outside surface comprise a first surface extending transversely inwardly in the longitudinal direction of the body at an acute angle to the longitudinal axis of the body, a second surface extending from the first surface in the longitudinal direction of the body and generally parallel with the longitudinal axis of the body and a third surface extending from the second surface transversely outwardly of the body at an angle of approximately 90° to the longitudinal axis of the body. With this configuration, yarn carrying areas are provided which receive the yarn and retain the yarn therein to prevent sloughing-off or migration of the yarn during winding and unwinding on the carrier.

The stepped portions of the outside surface of the body preferably extend in the opposite direction of the inward taper of the body and the stepped portions of the inside surface of the body extend in the same direction as the inward taper of the body. Alternatively, the stepped portions of the outside surface of the body may extend in the opposite direction of the taper of the body and the stepped portions of the surface of the body extend in the same direction as the inward taper of the body for the upper one-half of the longitudinal length of the body and the lower one-half of the body may have the stepped portions extending in opposite directions as the upper one-half of the body for further aiding in preventing sloughing-off or migration of the yarn during both the winding and unwinding operations, particularly during crosswinding and unwinding where the direction changes.

BRIEF DESCRIPTION OF THE DRAWINGS

While some of the objects and advantages of this invention have been discussed above, other objects and advantages will become apparent as the detailed description of preferred embodiments of this invention continues in conjunction with the accompanying drawings, in which.

DETAILED DESCRIPTION OF PREFERRED EMBODIMENTS

Figure 2:
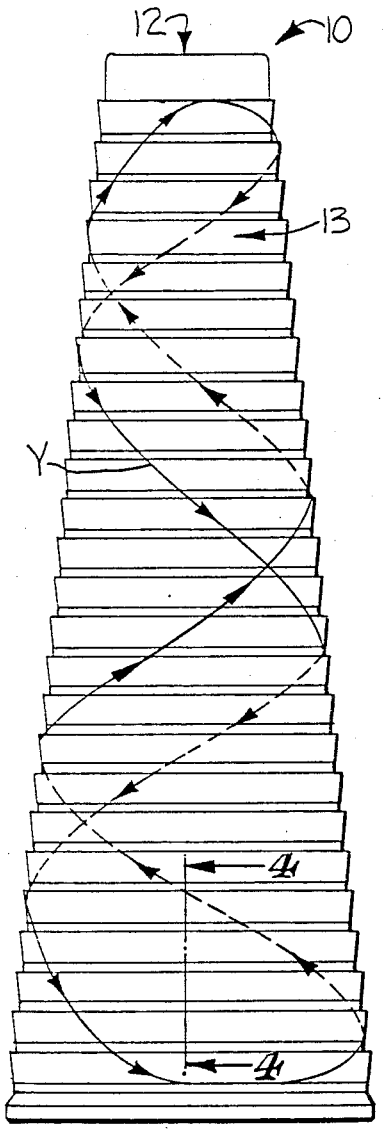
FIG. 2 is an enlarged side elevational view of the textile yarn carrier illustrated in FIG. 1, without the yarn wound thereon, but schematically illustrating the direction of the wind of the yarn.
Figure 1:
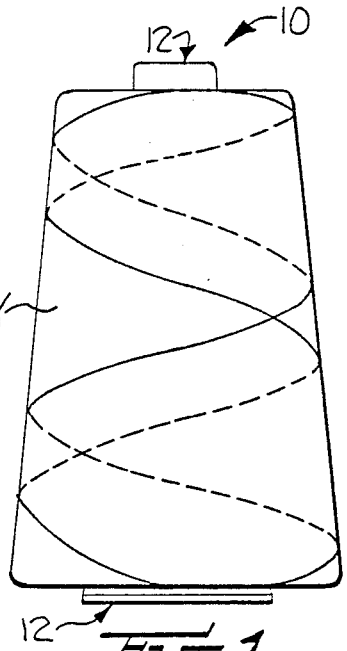
FIG. 1 is a side elevational view of textile yarn wound on a first embodiment of a carrier constructed in accordance with this invention and schematically illustrating the crossed wound nature of the yarn in the package.

Referring now the the drawings, there is illustrated in FIGS. 1–4 a first embodiment of a carrier 10 for textile yarn Y and in FIGS. 5–10 a second embodiment of a carrier 10' for textile yarn Y, both of which are constructed in accordance with this invention. It will be noted that the first and second embodiments of textile yarn carriers 10, 10' illustrated in FIGS. 1–4 and 5–10, respectively, are both in the overall shape of a cone or tapered carrier; however, as pointed out above, this invention is also applicable to cylinders, spools, tubes, pirns and other shapes having an elongate hollow body with a transverse circular cross-section.

Referring to the first embodiment of a carrier 10 for the winding and unwinding of textile yarn Y thereon, as illustrated in FIGS. 1–4, this carrier 10 comprises an elongate hollow body 12 having a transverse circular cross-section and defining an outside surface 13 for receiving wound textile yarn Y thereon and an inside surface 14 for mounting the carrier 10 on a spindle of a textile machine (not shown) for winding and unwinding of the yarn. Such winding operation in a textile machine and the spindle construction for receiving and mounting a carrier on the inside surface thereof are well known to those with ordinary skill in the art and further illustration or description thereof is not believed necessary for an understanding of the present invention.

Figure 4:
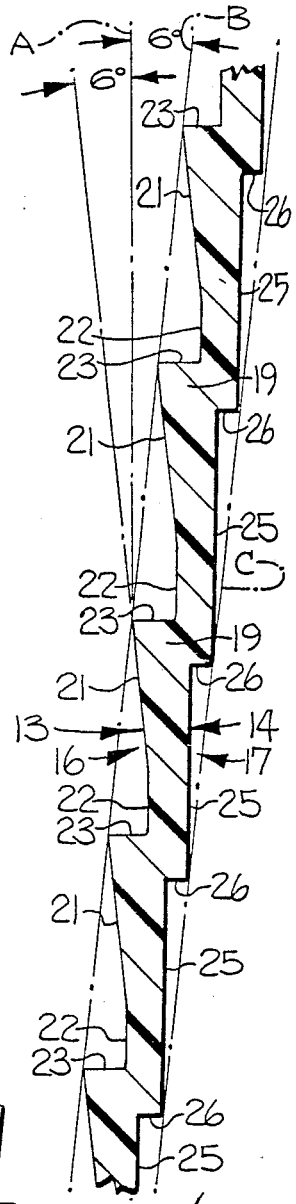
FIG. 4 is an enlarged sectional view, taken generally along the line 4—4 of FIG. 2.
Figure 3:
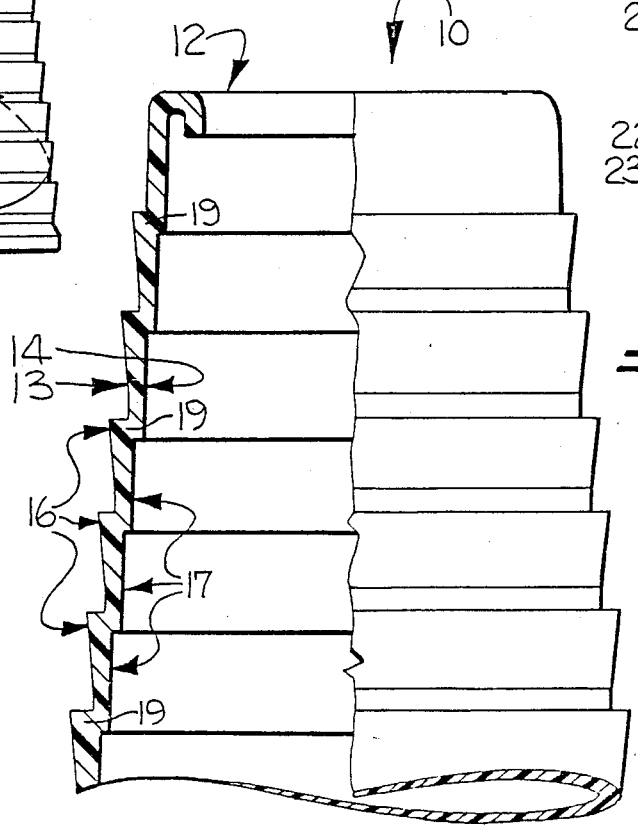
FIG. 3 is a further enlarged partial side elevational view of the upper portion of the textile yarn carrier of FIG. 2, which has been broken away and is partially in section for illustrating the inside surface and longitudinal cross-sectional configuration.
Figure 5:
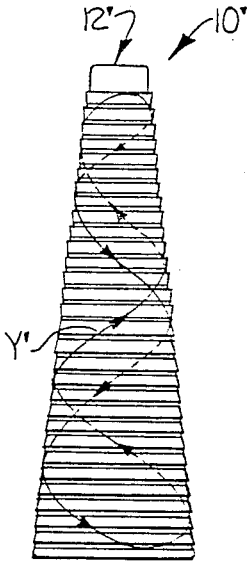
FIG. 5 is a side elevational view, like FIG. 2, of a second embodiment of textile yarn carrier constructed in accordance with this invention.
Figure 7:
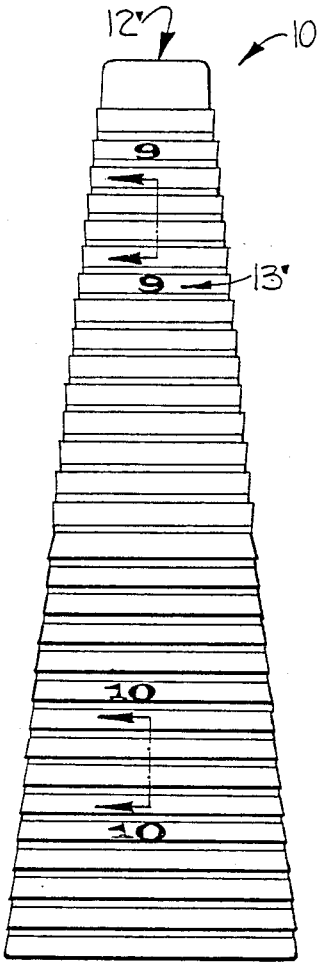
FIG. 7 is an enlarged side elevational view of the second embodiment of textile yarn carrier illustrated in FIG. 5.
Figure 8:
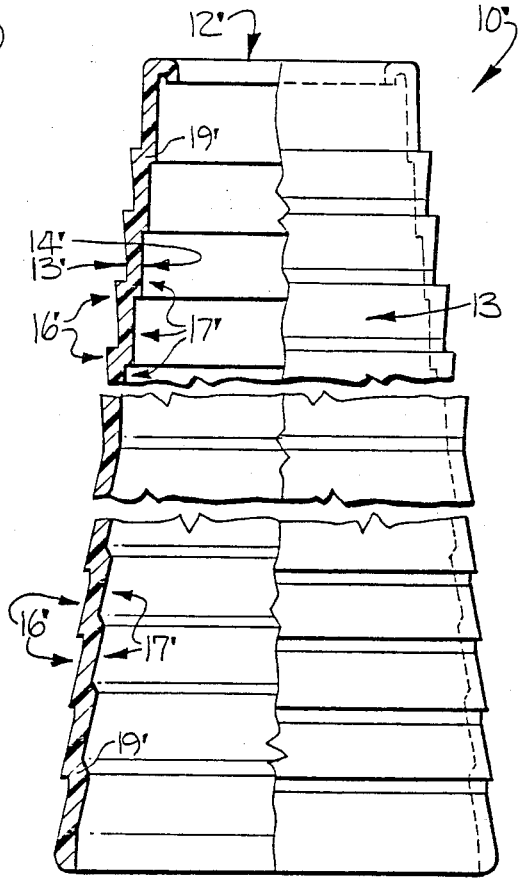
FIG. 8 is a further enlarged side elevational view of the second embodiment of textile yarn carrier illustrated in FIGS. 5 and 7 and being broken away to illustrate the inside surface and the longitudinal cross-sectional configuration of the carrier.
Figure 6:
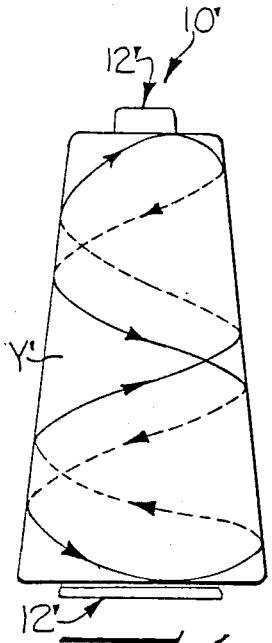
FIG. 6 is a side elevational view of the second embodiment of textile yarn carrier of FIG. 5 with textile yarn wound thereon into a yarn package and schematically illustrating the direction of wind of the textile yarn.
Figure 9:
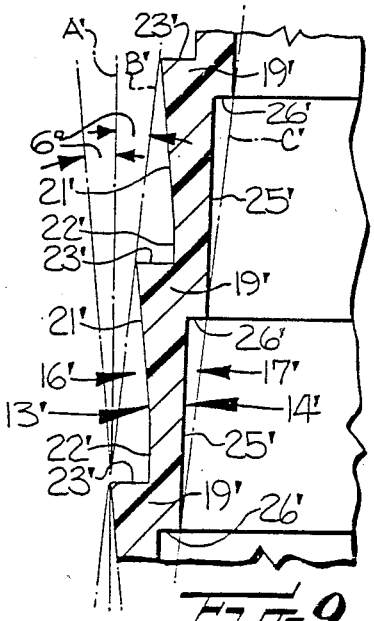
FIG. 9 is an enlarged section view, taken generally along the line 9—9 of FIG. 7, showing the stepped configuration of the inside and outside surfaces of the carrier at the top portion of the carrier.

The outside surface 13 of the hollow body 12 of the yarn carrier 10 comprises consecutive stepped portions 16 extending around the body 12 along substantially the length of the carrier 10 for defining a generally saw-toothed longitudinal cross-section and yarn carrying areas, as shown specifically in FIGS. 3 and 4, which prevent undesirable sloughing-off or migration of the textile yarn Y during winding and unwinding.

The inside surface 14 of the hollow body 12 of the yarn carrier 10 also comprises consecutive stepped portions 17 extending around the body 12 along substantially the length of the carrier 10 for defining a generally saw-toothed longitudinal cross-section and for cooperating with the outside surface 13 to reduce the amount of material needed to construct the carrier 10.

As may be seen in FIGS. 3 and 4, opposing stepped portions 16, 17 of the outside surface 13 and the inside surface 14 are positioned in a generally longitudinally staggered relationship for defining transverse portions 19 in the body 12 which are of the same radial thickness as would be present if the outside and inside surfaces 13, 14 were of a smooth unstepped configuration, as indicated by the dash dot lines B and C in FIG. 4, to provide reinforcement and crush strength to the carrier 10.

Referring now specifically to FIG. 4, each of the stepped portions 16 of the outside surface 13 of the body 12 of the carrier 10 comprises a first surface 21 extending transversely inwardly in the longitudinal direction of the body at an acute angle to the longitudinal axis A of the body 12, a second surface 22 extending from the first surface 21 in the longitudinal direction of the body 12 and being generally parallel with the longitudinal axis A of the body 12, and a third surface 23 extending from the second surface 22 transversely outwardly of the body 12 at angle of approximately 90° to the longitudinal axis A of the body 12. These surfaces 21, 22, 23 of the stepped portions 16 of the outside surface 13 of the body 12 of the carrier 10 function to receive the yarn Y as it is transversely wound onto the carrier 10 and maintain and hold the yarn Y to prevent sloughing-off or migration of the yarn Y during both the winding onto the outside surface 13 and the winding off of the outside surface 13. The inwardly tapering surface 21 and the parallel surface 22, with respect to the longitudinal axis A, serve to provide a smooth yarn receiving and retaining surface to prevent snagging or damage to the yarn Y during winding and unwinding, and the surface 23 cooperates with the surfaces 21, 22 to form a yarn retaining stepped area.

Each of the stepped portions 17 of the inside surface 14 of the body 12 of the carrier 10, comprise a first surface 25 extending transversely inwardly in the longitudinal direction of the body 12 and a second surface 26 extending from the first surface 25 outwardly of the body 12. These stepped portions 17 on the inside surface 14, along with the stepped portions 16 on the outside surface 13, reduce the amount of material needed to construct the body 12 of the carrier 10, while retaining the desired crush strength through the reinforced areas 19 to prevent damage to the carrier 10 from the forces created by the wound yarn Y.

Preferable, as illustrated in the drawings, the hollow body 12 of the carrier 10 comprises a generally conical shape having an inward taper extending at an acute angle to the longitudinal axis A of the body 12. When the body 12 of the carrier 10 comprises such conical shape, the acute angles of the taper of the body 12 and of the first surfaces 21, 25 of the stepped portions 16, 17 of the outside and inside surfaces 13, 14 of the body 12 are equal. For example, if the body 12 ofthe carrier 10 is constructed of as approximately 6° tapered cone, the first surfaces 21, 25 of the stepped portions 16, 17 of the outside and inside surfaces 13, 14 of the body 12 will also be approximately 6°, as illustrated in the drawings.

The carrier 10, as discussed above, may be constructed of any suitable material; it has been found that molded plastic material, particularly polypropylene, is desirable for this type of yarn carrier 10. The stepped portions 16 of the outside surface 13 of the body 12 of the carrier 10 extend in the opposite longitudinal direction of the inward taper of the body 12, and the stepped portions 17 of the inside surface 14 of the body 12 extend in the same direction as the inward longitudinal taper of the body 12, as may be clearly seen in FIGS. 3 and 4.

Referring now to the second embodiment of yarn carrier 10' illustrated in FIGS. 5–10, like reference numerals with prime notations have been utilized in this second embodiment of yarn carrier 10' for components which correspond to those of the first embodiment of yarn carrier 10 illustrated in FIGS. 1–4 and the description of these like components will not be further described with respect to this second embodiment of yarn carrier 10'.

By way of background with respect to this second embodiment of yarn carrier 10', when winding and unwinding certain types of yarns, particularly with a transversing cross-wind, problems still exist with respect to sloughing-off or migration of the yarn as the direction of winding and unwinding changes. Accordingly, to help minimize this problem with certain types of yarns, the stepped portions 16' of the outside surface 13' of the body 12' of the carrier 10' extend in the opposite direction from the inward longitudinal taper of the body 12 and the stepped portions 17' of the inside surface 14' of the body 12' extend in the same direction as the inward longitudinal taper of the body 12 for approximately the upper one-half of the longitudinal length of the body 12, just as these stepped portions 16, 17 are oriented in the first embodiment of yarn carrier 10. However, the stepped portions 16', 17' extend in respective opposite directions for the other or lower approximately one-half of the longitudinal length of the body 12', as may be clearly seen in FIGS. 7–10. This provides yarn retaining stepped areas 16' on the outside surface 13' of the body 12' which extend in opposite longitudinal directions for each one-half of the longitudinal length of the carrier 10', so as to aid in retaining yarn Y during crosswinding and unwinding in opposite directions.

Figure 10:
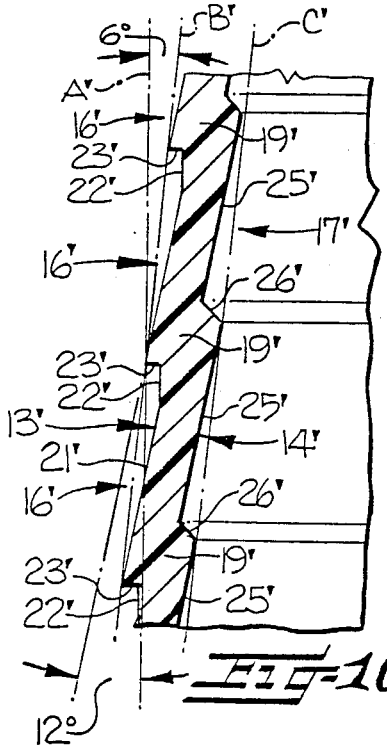
FIG. 10 is an enlarged sectional view, taken generally along the line 10—10 of FIG. 7, illustrating the longitudinal cross-sectional configuration of the stepped portions of the inside and outside surface of the carrier at the lower portion of the carrier.

Referring to FIG. 10, the surface 26' has been changed, from 90° to the longitudinal axis A of the carrier 10, to 45° to aid in removing of the carrier 10 from a mold when the carrier 10 is constructed of plastic materials.

Thus, this invention has provided a carrier for textile yarn, two preferred embodiments of which have been illustrated and described above, which prevents undesirable sloughing-off or migration of the textile yarn during winding and unwinding and which reduces the amount of material needed to construct the carrier while retaining desired crush strength.

In the drawings and specification there have been set forth embodiments of the invention and although specific terms are employed, they are used in a generic and descriptive sense only and not for purposes of limitation, the scope of the invention being defined in the following.

What is claimed is:

1. A carrier for textile yarn characterized by a construction designed to prevent undesirable sloughing-off or migration of the textile yarn during winding and unwinding and to reduce the amount of material needed to construct said carrier while retaining desired crush strength; said carrier comprising:

an elongate hollow body having a transverse circular cross-section and defining an outside surface for receiving wound textile yarn thereon and an inside surface for mounting said carrier on a spindle of a textile machine for winding and unwinding of the yarn;

said outside surface comprising consecutive individual stepped portions extending circular around said body along substantially the length of said carrier for defining a generally saw-toothed longitudinal cross-section and yarn carrying areas which prevent undesirable sloughing-off or migration of the textile yarn during winding and unwinding;

said inside surface comprising consecutive individual stepped portions extending circular around said body along substantially the length of said carrier for defining a generally saw-toothed longitudinal cross-section and for cooperating with said outside surface to reduce the amount of material needed to construct said carrier; and opposing stepped portions of said outside surface and said inside surface being positioned in a generally longitudinally staggered relationship for defining transverse portions in said body of the same radial thickness as would be present if said outside and inside surfaces were of a smooth unstepped configuration to provide reinforcement and crush strength to said carrier.

2. A carrier for textile yarn, as set forth in claim 1, in which said body of said carrier comprises molded plastic material.

3. A carrier for textile yarn, as set forth in claim 2, in which said plastic material comprises polypropylene.

4. A carrier for textile yarn, as set forth in claim 2, in which each of said stepped portions of said inside surface comprise a first surface extending transversely inwardly in the longitudinal direction of said body at an acute angle to the longitudinal axis of said body, and a second surface extending from said first surface transversely outwardly of said body.

5. A carrier for textile yarn, as set forth in claim 1 or 4, in which each of said stepped portions of said outside surface comprise a first surface extending transversely inwardly in the longitudinal direction of said body at an acute angle to the longitudinal axis of said body, a second surface extending from said first surface in the longitudinal direction of said body and generally parallel with the longitudinal axis of said body, and a third surface extending from said second surface transversely outwardly of said body at an angle of approximatey 90° to the longitudinal axis of said body.

6. A carrier for textile yarn, as set forth in claim 5, in which said body comprises a generally conical shape having an inward taper extending at an acute angle to the longitudinal axis of said body.

7. A carrier for textile yarn characterized by a construction designed to prevent undesirable sloughing-off or migration of the textile yarn during winding and unwinding and to reduce the amount of material needed to construct said carrier while retaining desired crush strength; said carrier comprising:

an elongate body comprising molded plastic material, a generally conical shape having an inward taper extending at an acute angle to the longitudinal axis of said body, a transverse circular cross-section, and an outside surface for receiving wound textile yarn thereon and an inside surface for mounting said carrier on a spindle of a textile machine for winding and unwinding of the yarn;

said outside surface comprising consecutive stepped portions extending around said body along said substantially the length of said carrier for defining a generally saw-toothed longitudinal cross-section and yarn carrying areas which prevent undesirable sloughing-off or migration of the textile yarn during winding and unwinding, each of said stepped portions comprising a first surface extending transversely inwardly in the longitudinal direction of said body at an acute angle to the longitudinal axis of said body, a second surface extending from said first surface in the longitudinal direction of said body and generally parallel with the longitudinal axis of said body, and a third surface extending from said second surface transversely outwardly of said body at an angle of approximately 90° to the longitudinal axis of said body;

said inside surface comprising consecutive stepped portions extending around said body along substantially the length of said carrier for defining a generally saw-toothed longitudinal cross-section and for cooperating with said outside surface to reduce the amount of material needed to construct said carrier, each of said stepped portions comprising a first surface extending transversely inwardly in the longitudinal direction of said body at an acute angle to the longitudinal axis of said body, and a second surface extending from said first surface transversely outwardly of said body; and opposing stepped portions of said outside surface and said inside surface being positioned in a generally longitudinally staggered relationship for defining transverse portions in said body of the same radial thickness as would be present if said outside and inside surfaces were of a smooth unstepped configuration to provide reinforcement and crush strength to said carrier.

8. A carrier for textile yarn, as set forth in claim 7, in which said acute angles of said taper of said body and of said first surfaces of said stepped portions of said outside and inside surfaces of said body are equal.

9. A carrier for textile yarn, as set forth in claim 1 or 7, in which each of said stepped portions of said outside surfaces of said body extend in the opposite direction of the inward longitudinal taper of said body.

10. A carrier for textile yarn, as set forth in claim 9, in which said stepped portions of said inside surface of said body extend in the same direction as the inward longitudinal taper of said body.

11. A carrier for textile yarn, as set forth in claim 1 or 7, in which said stepped portions of said outside surface of said body extend in the opposite direction from the inward longitudinal taper of said body for approximately the upper one-half of the longitudinal length of said body and extend in the same direction for the other approximately one-half of the longitudinal length of said body.

12. A carrier for textile yarn, as set forth in claim 11, in which said stepped portions of said inside surface of said body extend in the same direction as the inward longitudinal taper of said body for approximately the upper one-half of the longitudinal length of said body and extend in an opposite direction for the other approximately one-half of the longitudinal length of said body.

* * * * *

UNITED STATES PATENT AND TRADEMARK OFFICE

CERTIFICATE OF CORRECTION

PATENT NO. : 4,742,972

DATED : May 10, 1988

INVENTOR(S) : Karl H. Rost and Samuel F. Adams

It is certified that error appears in the above-identified patent and that said Letters Patent is hereby corrected as shown below:

Column 3, line 2, before "taper" insert -- inward --.

Column 3, line 3, before "surface" insert -- inside --.

Column 5, line 30, before "it" insert -- however, --.

Column 6, line 39, "circular" should be -- circularly --.

Column 6, line 46, "circular" should be -- circularly --.

Signed and Sealed this

Twenty-fifth Day of October, 1988

*Attest:*

DONALD J. QUIGG

*Attesting Officer*

*Commissioner of Patents and Trademarks*